US005223364A

United States Patent [19]

Maeda et al.

[11] Patent Number: 5,223,364

[45] Date of Patent: Jun. 29, 1993

[54] ELECTROPHOTOGRAPHIC PHOTOCONDUCTOR AND A METHOD FOR PREPARING THE SAME

[75] Inventors: Tatsuo Maeda, Kobe; Eiichi Miyamoto, Osaka; Nariaki Muto, Daito, all of Japan

[73] Assignee: Mita Industrial Co., Ltd., Osaka, Japan

[21] Appl. No.: 724,664

[22] Filed: Jul. 2, 1991

[30] Foreign Application Priority Data

Jul. 4, 1990 [JP] Japan ..... 2-178392

[51] Int. Cl.[5] ..... G03G 5/14

[52] U.S. Cl. ..... 430/73; 430/74

[58] Field of Search ..... 430/58, 73, 74

[56] References Cited

U.S. PATENT DOCUMENTS 4,419,427 12/1983 Graser et al. ..... 430/58
5,019,473 5/1991 Nguyen et al. ..... 430/73

FOREIGN PATENT DOCUMENTS 54849 10/1974 Australia .
0061089 9/1982 European Pat. Off. .
0314195 5/1989 European Pat. Off. .
61-87158 5/1986 Japan .
63-85750 4/1988 Japan .
1-118147 5/1989 Japan .

*Primary Examiner*—John Goodrow
*Attorney, Agent, or Firm*—Nikaido, Marmelstein, Murray & Oram

[57] ABSTRACT

The electrophotographic photoconductor of the present invention includes a conductive substrate and a photosensitive layer containing perylene pigment as a charge generating material formed on the conductive substrate. The X-ray diffraction peak of the perylene pigment exhibits its peak when the value of $2\theta$ is $14°(\pm 0.3°)$, and the half-width of the peak when the value of $2\theta$ is $14°$ $(\pm 0.3°)$ is 0.5 or more. This electrophotographic photoconductor has excellent qualities of low residual potential and stabilized quality.

7 Claims, 2 Drawing Sheets

ELECTROPHOTOGRAPHIC PHOTOCONDUCTOR AND A METHOD FOR PREPARING THE SAME

BACKGROUND OF THE INVENTION

1. Field of the Invention

The present invention relates to an electrophotographic photoconductor for use in an image-forming apparatus such as an electro-static copying machine or a laser printer, and more particularly to an electrophotographic photoconductor utilizing perylene pigment as a charge generating material and a method for preparing the same.

2. Description of the Prior Art

A coating solution for a photoconductor is prepared by dissolving binding resin in a solvent and then mixing a charge generating material, a charge transport material, etc., therein. This coating solution is applied onto a conductive substrate in lamination or monolayer, and then dried to prepare a photoconductor. The photoconductor obtained by the use of the coating solution has the advantages of high capability of forming a film and high productivity because it can be produced in a coating process. The photoconductor has further advantages in that the selection of pigment, etc., may freely control the photosensitive property, etc. Accordingly, the photoconductor has been studied in many respects.

As a charge generating material present in the aforesaid coating solution, perylene pigment may be used. This perylene pigment can be obtained usually by reacting perylene tetracarboxylic acid anhydride with an amine compound.

An electrophotographic organic photoconductor using perylene pigment thus synthesized requires properties such as sufficient sensitivity and repeatability to be a photoconductor. As a factor which controls the properties of the photoconductor, the properties such as the purity, the type of crystal, and the particle size of the pigment have been studied.

These properties of the pigment affect not only the aforesaid properties of the photoconductor but also the stability of preserving a coating solution, so the crude pigment after being synthesized requires various treatments immediately.

The applicant of the present invention filed an application regarding a monolayer positively charged photoconductor having excellent repeatability and aging property utilizing perylene pigment as a charge generating material in Japanese Laid-Open Patent Publication No. 63-85750. In this publication, the perylene pigment is prepared in the following manner.

The synthesized perylene pigment is dissolved in sulfuric acid, after which the sulfric acid solution is dropped into ice water to prepare $\alpha$ type perylene pigment. Thereafter, the resulting dispersion is washed with water to prepare a crude material. To the crude material is added nitrobenzene or dichloromethane to prepare $\beta$ type perylene pigment. Then, the resulting $\beta$ type perylene pigment solution is treated in a ball mill to prepare $\alpha$ and $\beta$ type perylene pigment. Thereafter, to the resulting mixture is added methanol to be filtered, and then the filtered substance is dried and classified to obtain perylene pigment having a particle size in the range of 0.05 $\mu$m to 0.1 $\mu$m.

However, when a coating solution for a photoconductor is prepared by the use of the perylene pigment obtained by the above method as a charge generating material, the particle size of the perylene pigment increases due to the crystal growth in the coating solution. As a result, when copying by the use of the resulting photoconductor, there occurs a deficiency in that the surface potential (residual potential) of the photoconductor becomes high after exposure, which markedly occurs in the case of a monolayer photoconductor.

SUMMARY OF THE INVENTION

The electrophotographic photoconductor of this invention, which overcomes the above-discussed and numerous other disadvantages and deficiencies of the prior art, comprises: a conductive substrate and a photosensitive layer containing perylene pigment as a charge generating material formed on the conductive substrate, wherein the X-ray diffraction peak of the perylene pigment exhibits its peak when the value of $2\theta$ is 14° (±0.3°), and the half-width of the peak when the value of $2\theta$ is 14° (±0.3°) is 0.5 or more.

In a preferred embodiment, the perylene pigment has a particle size in the range of 0.01 to 0.05 $\mu$m.

In a preferred embodiment, the perylene pigment is represented by the general formula as follows;

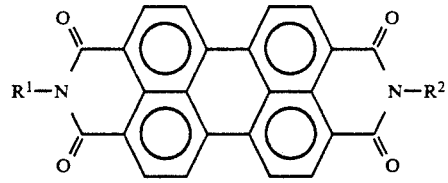

in the formula, $R^1$ and $R^2$ are independently an alkyl aryl group or a phenyl group.

In a preferred embodiment, the perylene pigment is represented by the general formula as follows;

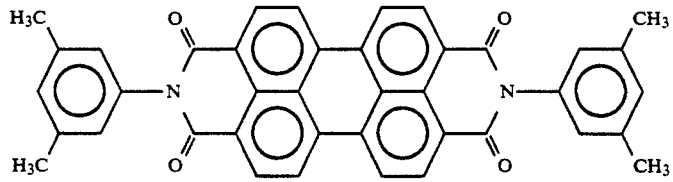

In a preferred embodiment, the perylene pigment has a pH in the range of 6.3 to 7.7.

A method for preparing an electrophotographic photoconductor including a conductive substrate and a photosensitive layer containing perylene pigment as a charge generating material formed on the conductive substrate, comprising:

a process for preparing perylene pigment the X-ray diffraction peak of which exhibits its peak when the value of $2\theta$ is 14° (±0.3°), the half-width of the peak when the value of $2\theta$ is 14° (±0.3° ) being 0.5 or more, by grinding perylene pigment the X-ray diffraction peak of which exhibits its peak when the value of $2\theta$ is 14° (±0.3°), the half-width of the peak when the value of $2\theta$ is 14° (±0.3°) being less than 0.5;

a process for preparing a coating solution for a photoconductor containing the perylene pigment; and, a process for applying the coating solution onto the conductive substrate and drying the coating solution.

Thus, the invention described herein makes possible the objectives of:

(1) providing an electrophotographic photoconductor with excellent quality of low residual potential by preventing the particle size of perylene pigment in a coating solution from being increased;

(2) providing an electrophotographic photoconductor with stabilized and high quality because of no large decrease in the quality of the coating solution during storage thereof;

(3) providing an electrophotographic photoconductor with high productivity by imparting longer life to the coating solution; and (4) providing a method for preparing an electrophotographic photoconductor having the aforesaid properties.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
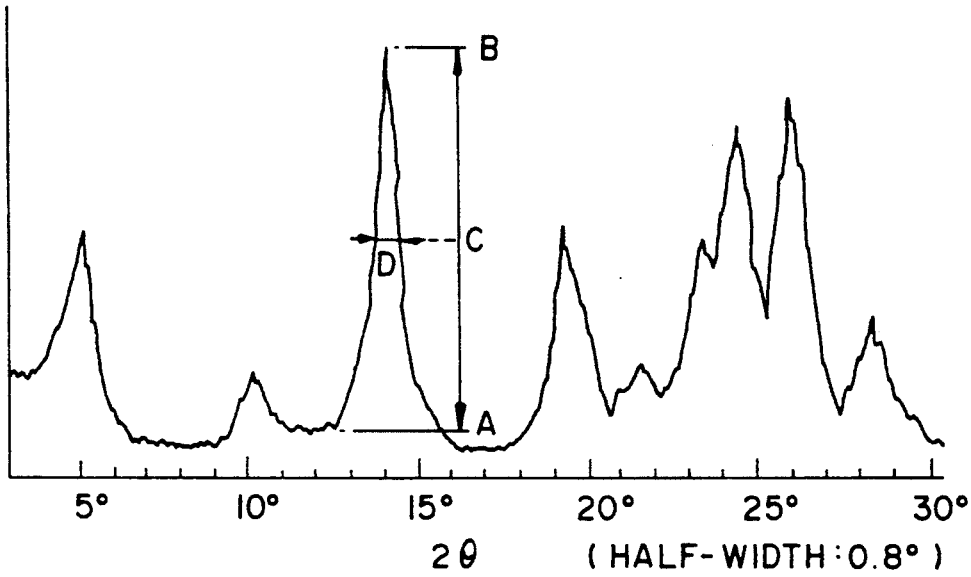
FIGS. 1 and 2 are charts showing the X-ray diffraction peak of perylene pigment of the present invention.

The electrophotographic photoconductor of the present invention can be prepared in the following manner. Binding resin, the aforesaid perylene pigment as a charge generating material, solvent, etc., are mixed to prepare a coating solution. The resulting coating solution is applied onto a conductive substrate, and then dried to form a photosensitive layer.

The above photosensitive layer can be classified into the following two kinds. One is a monolayer form having a charge generating material, a charge transport material, and binding resin. The other kind is a lamination form having a charge generating layer containing a charge generating material, and a charge transport layer containing a charge transport material.

An electrophotographic photoconductor having a monolayer photosensitive layer may be obtained by forming a monolayer containing perylene pigment as a charge generating material, a charge transport material, binding resin, etc., on the conductive substrate. On the other hand, an electrophotographic photoconductor having a lamination of photosensitive layers may be obtained in the following manner. A charge generating layer containing perylene pigment is formed on the conductive substrate. Then, a charge transport layer containing a charge transport material is formed on the charge generating layer. Alternatively, the build-up sequence may be reversed to form the charge generating layer on the charge transport layer. The electrophotographic photoconductor of the present invention can be applicable to any of the aforesaid types thereof.

The coating solution to form a photosensitive layer can be prepared by treating a charge generating material or a charge transport material, and binding resin in a known process, for example, a process by means of a roll mill, ball mill, attriter, a paint shaker, an ultrasonic dispersing apparatus, etc.

In a laminated electrophotographic photoconductor, a charge generating material and binding resin for constituting a charge generating layer may be used in various ratios. The preferable amount of the charge generating material to be used is in the range of 5 to 500 parts by weight per 100 parts by weight of binding resin, and more preferably in the range of 10 to 250 parts by weight.

The charge generating layer may have a suitable thickness. The preferable thickness is in the range of 0.01 to 5 μm, and more preferably in the range of 0.1 to 3 μm.

A charge transport material and binding resin for constituting a charge transport layer may be used in various ratios. In order to easily transport the charge generated in the charge generating layer by irradiation with light, it is preferable that the charge transport material be used in an amount in the range of 10 to 500 parts by weight per 100 parts by weight of binding resin, and more preferably in the range of 25 to 200 parts by weight.

It is preferable that the charge transport layer have a thickness in the range of 2 to 100 μm, and more preferably in the range of 5 to 30 μm.

In a monolayer electrophotographic photoconductor, a charge generating material may preferably be used in an amount in the range of 2 to 20 parts by weight per 100 parts by weight of binding resin, and more preferably in the range of 3 to 15 parts by weight. A charge transport material may preferably be used in an amount in the range of 40 to 200 parts by weight per 100 parts by weight of binding resin, and more preferably in the range of 50 to 100 parts by weight. The thickness of the photosensitive layer may preferably be in the range of 10 to 50 μm, and more preferably in the range of 15 to 25 μm.

Perylene pigment having a peak of the X-ray diffraction peak when the value of $2\theta$ is 14°, the half-width of the aforesaid peak when the value of 28 is 14° being 0.5 or more, is used in the present invention.

The "half-width" prescribed in the present invention represents the width of the peak at half height (c) of the peak (B) from a base line (A) in FIG. 1. The half-width when the value of $2\theta$ is 14° is about 0.8° in FIG. 1. Other than the peak when the value of $2\theta$ is 14°, the X-ray diffraction peak exhibits its peaks mainly when the value of $2\theta$ is 5°, 10°, 19°, 21.5°, 23.2°, 24.4°, 25.8°, and 28.2° (each value may have an extra width of ±0.3°).

The perylene pigment having such an X-ray diffraction peak has α type crystal structure, high efficiency of generating charge, and excellent charge transport property.

Perylene pigment having a structure represented by the following formula (I) may preferably be used in the present invention.

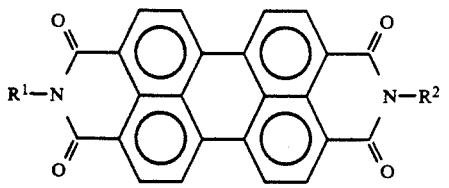

(I)

wherein $R^1$ and $R^2$ independently represents an alkyl aryl group or a phenyl group.

Particularly, perylene pigment having a structure represented by the following formula (II) is preferable.

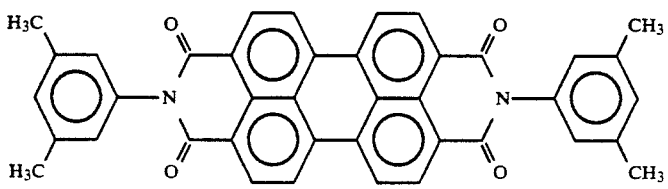

(II)

The perylene pigment for use in the present invention can be prepared, for example, in the following manner.

Generally, perylene pigment can be obtained by reacting perylene tetracarboxylic acid anhydride with a compound having an amino group. Since the synthesized perylene pigment contains an unreacted substance, i.e., an amine compound such as 3,5-xylidine, and a catalyst such as zinc chloride, etc., it may be purified according to a conventional process.

Examples of this purification process include water cleaning, acid cleaning, and alkali cleaning, by the use of washing such as water, an acid aqueous solution, and an alkali aqueous solution, respectively. These processes may be utilized in combination of two or more kinds thereof. Particularly, it is preferable that acid cleaning be utilized together with alkali cleaning, after which water cleaning be conducted. An amine compound such as xylidine remaining in the pigment can be neutralized by the acid cleaning, and zinc chloride, etc., can be decomposed and removed by the alkali cleaning.

In the present invention, pigment may be used, the pH of which is in the range of 6.3 to 7.7 after cleaning with washing. The use of pigment having a pH of less than 6.3 adversely affects other materials such as binding resin, thereby lowering the aging property of the resulting photoconductor. On the other hand, when the pigment having a pH of more than 7.7 is used, an alkali component such as xylidine remains in the pigment, which traps carriers generated in a photosensitive layer, thereby lowering the sensitivity of the photoconductor.

The pigment having a pH in the aforesaid range is used to prepare a coating solution. The resulting coating solution is applied and dried to form a photosensitive layer, thereby obtaining a photoconductor with high quality. Accordingly, the purification degree may be prescribed so that the pH of the pigment to be used may be included within the aforesaid range, thereby involving only necessary purification processes. This eliminates the time and labor required for the unnecessary processes.

As stated above, synthesized (and purified) perylene pigment and solvent such as xylene are put into a dispersing apparatus. Then, the pigment is mechanically crushed and further ground by means of a dispersing apparatus such as a ball mill. Thereafter, the ground material is filtered, and to the filtered material is added solvent such as methanol. Then, the mixture is washed, filtered, and heat-treated to obtain perylene pigment for use in the present invention.

In a coating solution for a photoconductor utilizing the perylene pigment thus prepared, the condition of the crystals and the condition of cohesion of the charge generating material are difficult to change during storage thereof.

This may be attributable to the following fact. The perylene pigment synthesized in the above manner is treated with an organic solvent, and then subjected to a grinding process to form a crystal lattice defect of the pigment. Therefore, in the coating solution for a photoconductor, the crystal growth of the pigment is prevented and the increase in size and the cohesion of particles of the perylene pigment are inhibited. Consequently, even when a photoconductor is prepared by the use of a coating solution which has been left for a predetermined time, the quality of the photoconductor does not largely decrease.

When the half-width of the peak of the X-ray diffraction peak of the perylene pigment when the value of $2\theta$ is 14° is less than 0.5, in a coating solution for a photoconductor prepared by the use of this perylene pigment as a charge generating material, the increase in size of particles of the pigment due to the crystal growth is facilitated during storage thereof. Accordingly, a photoconductor prepared by the use of this coating solution has a deficiency of high surface potential after exposure.

The perylene pigment of the present invention preferably has a particle size in the range of 0.01 μm to 0.05 μm. When the particle size of the perylene pigment is less than 0.01 μm, or more than 0.05 μm, the charge generating efficiency becomes low, thereby lowering the sensitivity of the resulting photoconductor.

The aforesaid perylene pigment may be used independently, or in combination with other charge generating materials as a charge generating material.

Examples of other charge generating materials include selenium, selenium-tellurium, amorphous silicon, pyrylium salt, anthanthrone pigment, phthalocyanine pigment, indigo pigment, triphenylmethane pigment, indanthrene pigment, toluidine pigment, pyrazoline pigment, azo pigment, quinacridone pigment, etc.

As the aforesaid charge transport material, conventional charge transport materials can be used. Examples of the charge transport material include a nitrogen-containing cyclic compound such as an oxadiazole compound such as 2,5-di(4-methylaminophenyl)-1,3,4-oxadiazole, a styryl compound such as 9-(4-diethylaminostyryl)anthracene, a carbazole compound such as polyvinylcarbazole, a pyrazoline compound such as 1-phenyl-3-(P-dimethylaminophenyl)pyrazole, a hydrazone compound, a triphenylamine compound, an indole compound, an oxazole compound, an isooxazole compound, a thiazole compound, a thiadiazole compound, an imidazole compound, a pyrazole compound, and a triazole compound; and a condensed polycyclic compound. These charge transport materials can be used independently or in combination of two or more kinds thereof.

As the aforesaid binding resin, various kinds of conventional resin can be used. Examples of this binding resin include various kinds of polymer such as styrene polymer, styrene-butadiene copolymer, styrene-acrylonitrile copolymer, styrene-maleic acid copolymer, acrylic polymer, styrene-acrylic copolymer, ethylene-vinyl acetate copolymer, polyvinyl chloride, vinyl chloride-vinyl acetate copolymer, polyester, alkyd resin, polyamide, polyurethane, acrylic modified urethane resin, epoxy resin, polycarbonate, polyarylate, polysulfone, diallylphthalate resin, silicone resin, ketone resin, polyvinyl butyral resin, polyether resin, phenol resin. Photo-cure resin such as epoxy acrylate, etc., can also be used. Further examples of the binding resin may include photoconductive polymer such as poly-N-vinylcarbazole.

The aforesaid solvent can be selected from conventional solvents according to the kind of the aforesaid binding resin, etc. Examples of the solvent include alcohols such as methanol, ethanol, propanol, isopropanol, butanol; aliphatic hydrocarbon such as n-hexane, octane, and cyclohexane; aromatic hydrocarbon such as benzene, toluene, and xylene; halogenated hydrocarbon such as dichloromethane, dichloroethane, carbon tetrachloride, and chlorobenzene; ethers such as dimethyl ether, diethyl ether, tetrahydrofuran, ethyleneglycoldimethylether, and ethyleneglycoldiethylether; ketones such as acetone, methylethylketone, and cyclohexanone; and esters such as ethyl acetate and methyl acetate. These materials may be used independently or in combination of two or more kinds thereof.

In order to improve the dispersing property, the coating property, etc., of the charge transport material and the charge generating material, a photosensitive solution may further contain surfactant, leveling agent, etc.

Examples of the aforesaid conductive substrate include metallic simple substance such as aluminium, copper, tin, platinum, silver, vanadium, molybdenum, chrome, cadmium, titanium, nickel, palladium, indium, stainless steel, and brass; plastic materials vacuum-evaporated or laminated with the aforesaid metal; glass coated with aluminum iodide, tin oxide, indium oxide, etc., and the like.

The conductive substrate may have any form such as sheet-like, and drum-like forms. The substrate itself has conductivity, or the surface of the substrate has conductivity. The preferable substrate has sufficient mechanical strength for use.

EXAMPLES

The present invention will now be explained in detail by reference to examples.

The Preparation of an Electrophotographic Photoconductor

EXAMPLE 1

One hundred parts by weight of N,N-di(3,5-dimethylphenyl)perylene-3,4,9,10-tetracarboxylic acid diimide (PV Fast Red B, manufactured by Hoechst Co.) and 2,000 parts by weight of xylene as a solvent are put into a paint shaker to be crushed with zirconia beads for 1 hour, after which the mixture was ground in a ball mill for 3 days.

Then, the mixture was filtered, to which was added 1,000 parts by weight of methanol, and then the mixture was filtered. This filtering step was repeated for three times, after which heat treatment was conducted to obtain perylene pigment.

The measurement of the X-ray diffraction peak of the perylene pigment thus obtained showed that the half-width of the peak when the value of $2\theta$ was 14° was 0.6°.

One part by weight of this perylene pigment and 40 parts by weight of tetrahydrofuran were stirred and mixed for 1 minute by means of an ultrasonic dispersing apparatus. To the mixture was added 100 parts by weight of 10% solution of polyvinylcarbazole (manufactured by ANAN KORYO CO., TSUBICOL 210) in tetrahydrofuran as a charge transport material, which was subjected to secondary dispersion for 2 minutes by means of the ultrasonic dispersing apparatus to prepare a coating solution for a monolayer photosensitive layer.

The resulting coating solution was applied onto an aluminium foil by means of a wire bar (#28), and subjected to hot-air drying at 100° C. for 1 hour to form a monolayer photosensitive layer with a thickness of about 10 μm, thereby completing an electrophotographic photoconductor.

EXAMPLE 2

Perylene pigment was obtained in the same manner as in Example 1, except that the number of days for a grinding process in a ball mill was 5 days.

The X-ray diffraction peak of the perylene pigment thus obtained was measured and found to be as shown in FIG. 1, indicating that the half-width of the peak when the value of 28 was 14° was 0.8°.

A monolayer electrophotographic photoconductor was prepared in the same manner as in Example 1, except that this perylene pigment was used.

EXAMPLE 3

Perylene pigment was obtained in the same manner as in Example 1, except that the number of days for a grinding process in a ball mill was 7 days.

The measurement of the X-ray diffraction peak of the perylene pigment thus obtained showed that the half-width of the peak when the value of $2\theta$ was 14° was 1.0°.

A monolayer electrophotographic photoconductor was prepared in the same manner as in Example 1, except that this perylene pigment was used.

EXAMPLE 4

Perylene pigment was obtained in the same manner as in Example 1, except that the number of days for the grinding process in a ball mill was 10 days.

Figure 2:
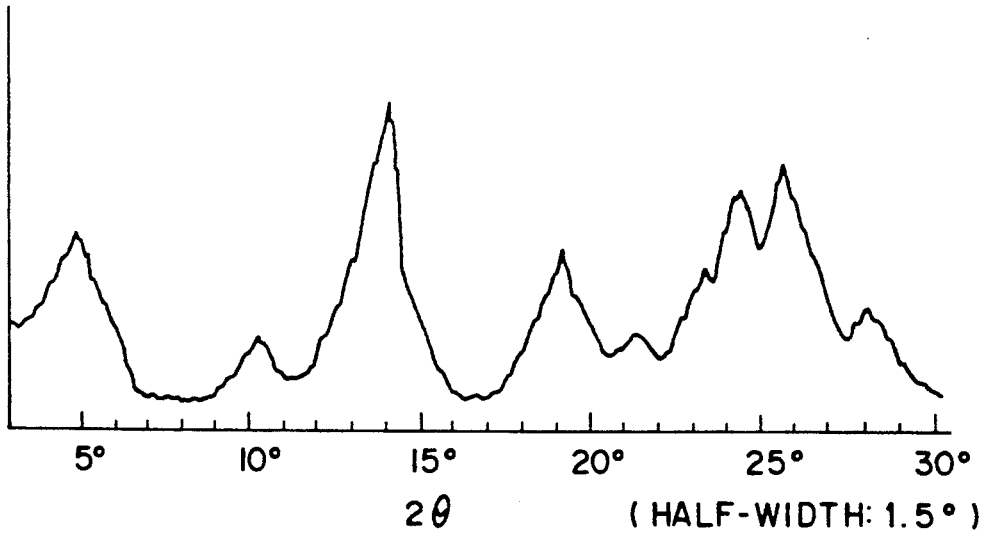

The X-ray diffraction peak of the perylene pigment thus obtained was measured and found to be as shown in FIG. 2, indicating that the half-width of the peak when the value of $2\theta$ was 14° was 1.5°.

A monolayer electrophotographic photoconductor was prepared in the same manner as in Example 1, except that this perylene pigment was used.

COMPARATIVE EXAMPLE 1

Perylene pigment was obtained in the same manner as in Example 1, except that the grinding process in a ball mill was not conducted.

Figure 3:
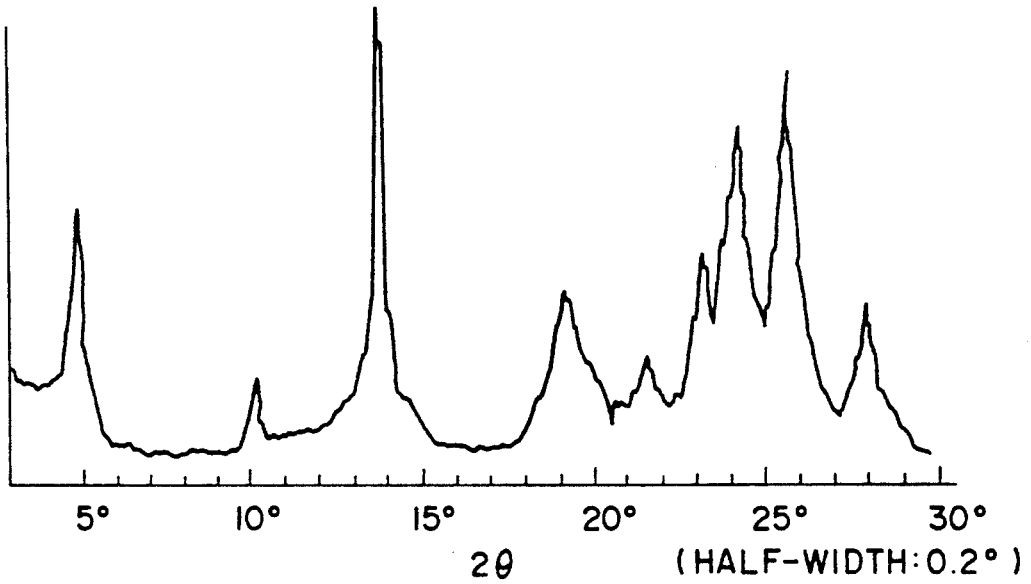
FIGS. 3 and 4 are charts showing the X-ray diffraction peak of the perylene pigment of Comparative Example.

The X-ray diffraction peak of the perylene pigment thus obtained was measured and found to be as shown in FIG. 3, indicating that the half-width of the peak when the value of $2\theta$ was 14° was 0.2°.

A monolayer electrophotographic photoconductor was prepared in the same manner as in Example 1, except that this perylene pigment was used.

COMPARATIVE EXAMPLE 2

Perylene pigment was obtained in the same manner as in Example 1, except that the number of days for the grinding process in a ball mill was 1 day.

The measurement of the X-ray diffraction peak of the perylene pigment thus obtained showed that the half-width of the peak when the value of $2\theta$ was 14° was 0.4°.

A monolayer electrophotographic photoconductor was prepared in the same manner as in Example 1, except that this perylene pigment was used.

COMPARATIVE EXAMPLE 3

Figure 4:
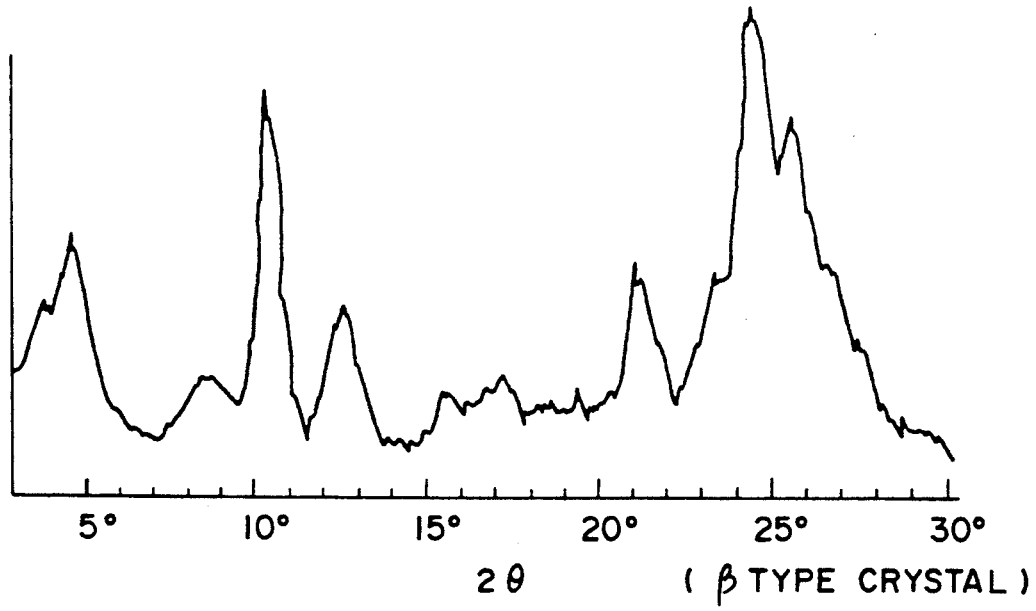

One part by weight of N,N-di(3,5-dimethylphenyl)-perylene-3,4,9,10-tetracarboxylic acid diimide (PV Fast Red B, manufactured by Hoechst Co.) was dissolved in 20 parts by weight of concentrated sulfuric acid, to which was added a large amount of water to be crystallized. Then, the solution was filtered. The resulting filtered substance was washed with water, and then with methanol for 2 times to obtain $\beta$ type perylene pigment having an X-ray diffraction peak as shown in FIG. 4.

A monolayer electrophotographic photoconductor was prepared in the same manner as in Example 1, except that 1 part by weight of this perylene pigment was used.

EXAMPLE 5

One part by weight of perylene pigment (the half-width when the value of $2\theta$ is 14° is 0.6°) obtained in the same manner as in Example 1 as a charge generating material, 1 part by weight of vinyl chloride-vinyl acetate as binding resin, and 60 parts by weight of tetrahydrofuran were used to prepare a dispersion by means of an ultrasonic dispersing apparatus. Then, the resulting dispersion was applied onto an aluminium plate, and dried at 100° C for 30 minutes to form a charge generating layer with a thickness of 0.5 μm.

Next, 0.7 parts by weight of N,N-di(3-tolyl)-N,N'di(4-tolyl)-1,3-phenylenediamine as a charge transport material, 1 part by weight of polycarbonate as binding resin, and 50 parts by weight of benzene were used to prepare a dispersion. Then, the resulting dispersion was applied onto the charge generating layer to form a charge transport layer with a thickness of 20 μm, thereby completing a laminated electrophotographic photoconductor.

COMPARATIVE EXAMPLE 4

A laminated electrophotographic photoconductor was prepared in the same manner as in Example 5, except that 1 part by weight of the same perylene pigment as that used in Comparative Example 2 (the half-width when the value of $2\theta$ is 0.4°) was used as a charge generating material.

The Evaluation of the Electrophotographic Photoconductor

The electrophotographic photoconductor thus obtained was installed in an electrostatic process copying test device (manufactured by KAWAGUCHI ELECTRIC CO., Model-8100). Then, the monolayer photoconductor was positively charged by applied voltage +5.5 KV, and the laminated photoconductor was negatively charged by applied voltage −5.5 KV. The characteristics of the photoconductor was measured under the conditions below. The results are shown in Table 1.

Exposure time: 10 seconds
Light for use in exposure: White light
Luminous intensity: 10 lux
Dark attenuation after being charged: 2 seconds In Table 1, $V_1$(V) denotes the initial surface potential (V) of the photoconductor when charged by application of voltage under the above conditions. $E_{1\frac{1}{2}}$ (lux.-sec) denotes the half-value exposure calculated from the exposure time required for the surface potential to decrease to $\frac{1}{2}$ of the initial surface potential $V_1$(V). The value of $V_1$r.P.(V) in Table is obtained by measuring the surface potential of the photoconductor which has been left for 5 seconds after exposure as residual potential.

As for a monolayer photoconductor, first, a coating solution for a photoconductor was prepared. Then, the resulting coating solution was kept for 10 days, and then applied onto an aluminium foil to prepare an electrophotographic photoconductor. This photoconductor was also evaluated under the same condition as described above. The results are shown in Table 2. As for this photoconductor obtained by the use of the coating solution which had been kept for 10 days, the initial surface potential, the half-value exposure, and the residual potential are denoted by $V_2$(V), $E_{2\frac{1}{2}}$ (lux.sec), and $V_2$r.p., respectively.

As apparent from Tables 1 and 2, the photoconductor using perylene pigment having a half-width when the value of $2\theta$ is 14° of 0.5° or more had high sensitivity and low residual potential. On the other hand, the photoconductor using perylene pigment having a half-width when the value of $2\theta$ is 14° of less than 0.5° had inferior sensitivity and high residual potential.

The coating solution for a photoconductor using perylene pigment having a half-width when the value of $2\theta$ is 14° of 0.5° or more did not largely decreased in quality during storage thereof, thereby not affecting the properties of the photoconductor. On the other hand, the coating solution for a photoconductor using perylene pigment having a half-width when the value of $2\theta$ is 14° of less than 0.5° decreased in quality during storage thereof, thereby affecting the properties of the photoconductor.

The photoconductor using perylene pigment having a $\beta$ type crystal structure was inferior in all properties such as sensitivity, residual potential, and keeping property of the solution.

TABLE 1

| | $V_1$(V) | $V_1$r.p.(V) | $E_{1\frac{1}{2}}$ (lux · sec) |
|---|---|---|---|
| Example 1 | 680 | 46 | 16.1 |
| Example 2 | 670 | 45 | 16.2 |
| Example 3 | 670 | 35 | 15.7 |
| Example 4 | 680 | 35 | 14.8 |
| Comparative Example 1 | 680 | 88 | 23.7 |
| Comparative | 670 | 70 | 19.8 |

TABLE 1-continued

| | $V_1$(V) | $V_1$r.p.(V) | $E_{1\frac{1}{2}}$ (lux · sec) |
|---|---|---|---|
| Example 2 | | | |
| Comparative Example 3 | 670 | 90 | 24.2 |
| Example 5 | −715 | −58 | 15.6 |
| Comparative Example 4 | −710 | −80 | 21.8 |

TABLE 2

| | $V_2$(V) | $V_2$r.p.(V) | $E_{2\frac{1}{2}}$ (lux · sec) |
|---|---|---|---|
| Example 1 | 670 | 50 | 17.2 |
| Example 2 | 680 | 47 | 16.7 |
| Example 3 | 690 | 40 | 16.2 |
| Example 4 | 680 | 35 | 15.1 |
| Comparative Example 1 | 650 | 105 | 33.1 |
| Comparative Example 2 | 640 | 90 | 23.7 |
| Comparative Example 3 | 680 | 120 | 32.3 |

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic photoconductor comprising a conductive substrate and a photosensitive layer containing perylene pigment as a charge generating material formed on said conductive substrate, wherein the X-ray diffraction peak of said perylene pigment exhibits its peak when the value of $2\theta$ is 5°, 10°, 14°, 19°, 21.5°, 23.2°, 24.4°, 25.8°, and 28.2° (each value may have an extra width of ±0.3°), and the half-width of said peak when the value of $2\theta$ is 14° (±0.3) is 0.5 or more, wherein said perylene pigment has a particle size in the range of 0.01 to 0.5 μm and is represented by the formula

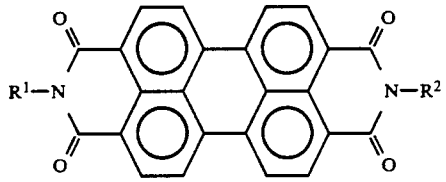

where $R^1$ and $R^2$ are independently an alkyl aryl group or a phenyl group.

2. An electrophotographic photoconductor according to claim 1, wherein said perylene pigment is represented by the general formula as follows;

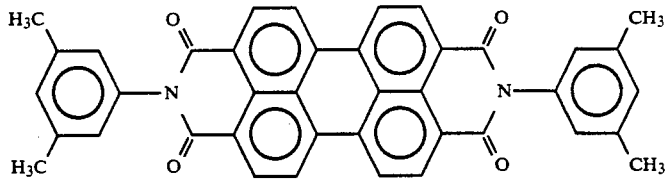

3. An electrophotographic photoconductor according to claim 1, wherein the pH of said perylene pigment is in the range of 6.3 to 7.7.

4. An electrophotographic photoconductor according to claim 1, wherein said perylene pigment can be obtained by grinding perylene pigment the X-ray diffraction peak of which exhibits its peak when the value of $2\theta$ is 14° (±0.3°), the half-width of said peak when $2\theta$ is 14° (±0.3° ) being less than 0.5.

5. A method for preparing an electrophotographic photoconductor including a conductive substrate and a photosensitive layer containing perylene pigment as a charge generating material formed on said conductive substrate, comprising:

grinding perylene pigment, the X-ray diffraction peak of which exhibits its peak when the value of $2\theta$ is 5°, 10°, 14°, 19°, 21.5°, 23.2°, 24.4°, 25.8°, and 28.2° (each value may have an extra width of ±0.3°), the half-width of said peak when the value of $2\theta$ is 14° (±0.3) being less than 0.5 to prepare a perylene pigment, the X-ray diffraction peak of which exhibits its peak when the value of $2\theta$ is 14° (±0.3), the half-width of the peak when the value of $2\theta$ is 14° (±0.3) being 0.5 or more;

preparing a coating solution for a photoconductor containing said perylene pigment; and applying said coating solution onto the conductive substrate and drying the coating solution;

wherein said perylene pigment has a particle size in the range of 0.01 to 0.05 μm.

6. A method for preparing an electrophotographic photoconductor according to claim 5, wherein said process for grinding the perylene pigment is conducted according to a wet method.

7. An electrophotographic photoconductor comprising a conductive substrate and a photosensitive layer containing perylene pigment as a charge generating material formed on said conductive substrate, wherein the X-ray diffraction peak of said perylene pigment exhibits its peak when the value of $2\theta$ is 14° (±0.3°), and the half-width of said peak when the value of $2\theta$ is 14° (±0.3°) is 0.5 or more, wherein said perylene pigment has a particle size in the range of 0.01 to 0.05 μm, and said X-ray diffraction peak further exhibits its peak when the value of $2\theta$ is 5°, 10°, 19°, 21.5°, 23.2°, 24.4°, 25.8°, and 28.2° (each value may have an extra width of ±0.3°).

* * * * *